US005437342A

United States Patent [19]

Powada

[11] Patent Number: 5,437,342

[45] Date of Patent: Aug. 1, 1995

[54] DRILL STRING PROTECTION

[76] Inventor: Frederick Powada, Bridge of Mondynes, Fordoun, Laurencekirk, Kincardineshire, AB30 1LD, United Kingdom

[21] Appl. No.: 155,256

[22] Filed: Nov. 19, 1993

[30] Foreign Application Priority Data

Nov. 20, 1992 [GB] United Kingdom ..... 9224359

[51] Int. Cl.[6] ..... E21B 17/10

[52] U.S. Cl. ..... 175/325.5; 166/242

[58] Field of Search ..... 175/325.5, 325.4, 325.6, 175/325.7, 426, 425, 320, 435; 166/242; 138/140–143

[56] References Cited

U.S. PATENT DOCUMENTS

| | | | |
|---|---|---|---|
| 3,480,094 | 11/1969 | Morris . | |
| 3,948,575 | 4/1976 | Rosser . | |
| 3,993,368 | 11/1976 | Jurgens et al. | 175/325.4 |
| 4,190,126 | 2/1980 | Kabashima | 175/426 |
| 4,296,973 | 10/1981 | Hartwell . | |
| 4,452,325 | 6/1984 | Radd et al. | 175/426 |
| 4,708,203 | 11/1987 | Walker . | |
| 4,796,670 | 1/1989 | Russell et al. . | |

FOREIGN PATENT DOCUMENTS

| | | |
|---|---|---|
| 0355855A2 | 2/1990 | European Pat. Off. . |
| 636142 | 8/1947 | United Kingdom . |
| 863371 | 8/1957 | United Kingdom . |
| 928527 | 3/1960 | United Kingdom . |
| 864606 | 4/1961 | United Kingdom . |
| 1039493 | 4/1964 | United Kingdom . |
| 1039494 | 4/1964 | United Kingdom . |
| 1501943 | 10/1975 | United Kingdom . |
| 1593370 | 12/1977 | United Kingdom . |
| 1496975 | 1/1978 | United Kingdom . |
| 1517872 | 7/1978 | United Kingdom . |
| 1530864 | 11/1978 | United Kingdom . |
| 1542401 | 3/1979 | United Kingdom . |
| 2069920 | 9/1981 | United Kingdom . |
| 2082429 | 3/1982 | United Kingdom . |
| 2172542 | 9/1986 | United Kingdom . |
| 2257607 | 7/1991 | United Kingdom . |
| 91/09720 | 7/1991 | WIPO . |

*Primary Examiner*—Stephen J. Novosad
*Attorney, Agent, or Firm*—Lowe, Price, LeBlanc & Becker

[57] ABSTRACT

A wear-resistant sheath for a cylindrical drill string component, includes a cylindrical fiber-reinforced matrix snugly embracing the drill string component. Embedded in the sheath is a spaced array of hard substantially cylindrical pins, each of which has a body having an opposed pair of ends. The pins are disposed substantially radially of the sheath, with one end of each pin disposed substantially at the outer surface of the sheath, the other end being preferably disposed in contact with the component and embedded therein to lock the sheath to the component.

5 Claims, 1 Drawing Sheet

FIG.1.
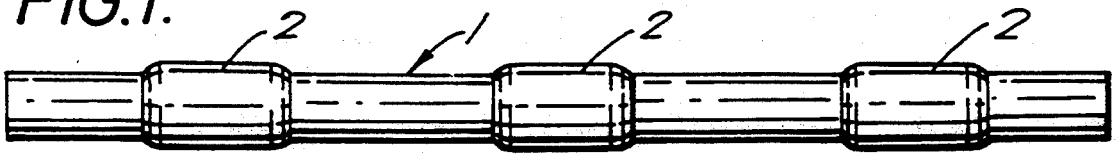
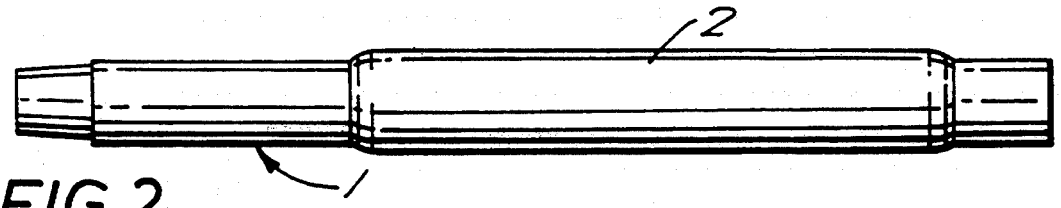
FIG.2.
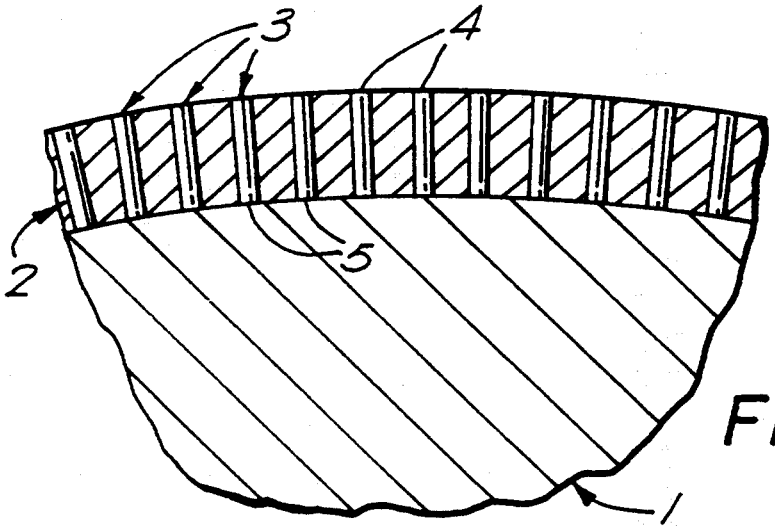
FIG.3.
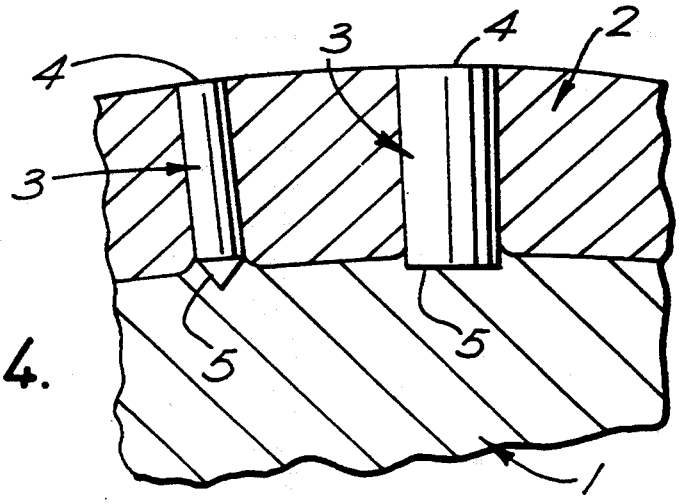
FIG.4.

DRILL STRING PROTECTION

FIELD OF THE INVENTION

The invention relates to drill string protection.

BACKGROUND OF THE RELEVENT ART

It is known from U.S. Pat. No. 4,708,203 of Phillips Petroleum, to provide a drill collar to protect equipment during oil or gas drilling operations, the collar being made from fibre reinforced plastics, being generally tubular and having a radially varying cross-sectional thickness.

It is known from GB 1530864 of Reed Tool to provide the exterior of a well tool with a deposit of sintered tungsten carbide in an alloy steel matrix, the deposit being at least partly covered by a layer of cast tungsten carbide welded to the deposit.

U.S. Pat. No. 3,480,094 of Morris suggests a drill collar comprising an elastomeric sleeve, the exterior surface of which includes a plurality of closely spaced ceramic elements to improve its heat and abrasion resistance.

U.S. Pat. No. 3,948,575 of Rosser suggests a drill string comprising annular rings of synthetic resin moulded around the string for non-damaging contact with the well casing.

U.S. Pat No. 4,796,670 of Exxon discloses a drill pipe protector which surrounds and embraces a section of drill pipe. The protector may be of elastomeric material in which a quantity of small hard particles are interspersed.

GB 1542401 of Van Moppes discloses a drill string stabiliser provided with inserts of hard material.

It is also known to coat drill sensors of the kind which provide measurement while drilling with a sheath of wear resisting fibre reinforced epoxy resin insulation.

It is also known to shrink on metal sleeves which are either intrinsically wear resisting or include wear resisting elements. These require that both the drill string outer surface and the sleeve inner surface are precisely machined and circular.

One known wear-resisting treatment uses a welded-on hard metal facing applied directly to the drill string component. Such welding processes adversely affect the parent metal, and lead to degradation of the parent metal. It is an object of the invention to provide a wear protection process which is non-destructive and can thus be repeated indefinitely.

Ideally, downhole drill components should remain integral in use. However it is inevitable that the generally metal components will wear, and I propose a solution whereby when wear occurs, damage is repairable, i.e. the component can be made good without the repair method causing degradation of the drill component. I also propose a solution in which the structure of the drill component is protected from wear.

Any drill debris, i.e. parts which detach in use due to wear, should be drillable. This means that any pieces which break off the drill string should either be soft, e.g. as soft as aluminium, or, if harder than say, cast iron, no bigger in any size than about 0.5 $cm^3$, the exact volume limit depending on drill bit type, the structure being drilled through, and the drilling conditions.

SUMMARY OF THE DISCLOSURE

From one aspect the invention is in the provision of a wear resistant sheath for a drill string or 'downhole' component, particularly tubular or cylindrical components, the sheath comprising a matrix in which is embedded a spaced array of hard pins, the heads of which are disposed at the outer surface of the sheath. Preferably the pins are packed together in the array. Preferably the pins are disposed in a radial array. Advantageously the inner ends of the pins are in contact with the component. The said inner ends of the pins may be embedded in the component. The pins may be of steel but are preferably of tungsten carbide. The pins are preferably cylindrical in shape.

The matrix may be of fibre-reinforced plastics or of metal. The fibres may be of-glass, carbon, aramid or metal, e.g. steel, or a mixture thereof. The fibres may be in strand, sheet, woven or discrete or chopped form. The plastics may be epoxy resin. The coat or sheath is preferably applied using a constricting belt to compact and mould the material to the component. Several layers of fibres, e.g. 5 to 50 may be used.

Preferably the fibre reinforcement is applied to the component in a series of plies and preferably these plies are not parallel to the surface of the component. In this case the pin-like members will help fill the voids which might otherwise form in the matrix away from the component surface.

The sheath or coating preferably extends continuously or substantially continuously over substantially the whole of the surface of the components, leaving, if required, a small exposed portion at the ends whereby the components can be gripped in a chuck to attach and detach the components from the drill string. If desired, circumferential bands of sheathing or coating can be applied to the components at positions where protection is most beneficial.

The matrix might be of brazing metal or another soft metal, e.g. aluminium, but is preferably of steel. The matrix is preferably in the form of a tubular member snugly embracing the drill string component. It may be shrunk onto the component or secured thereto by means of an adhesive.

The pins may have inner ends arranged, e.g. pointed, to penetrate slightly the component. Alternatively the inner ends of the pins may be punched into the component surface or may be received in the pre-formed, e.g. drilled, recesses. Thus the matrix may be fixed to the component mechanically. This might be particularly useful where the component is slightly worn and thus not readily capable of receiving a shrunk-on sleeve.

The size of each of the pins will be chosen to be small such that if detached from the matrix in use, they are incapable of seriously damaging the drill string or bit.

From another aspect the invention provides a stabilizer blade, which may be of straight or spiral form, for a drill string component, comprising a matrix on or defining the component and supporting a plurality of small hard pins. The matrix and the pins are as described above. It is conventional for stabilisers to be tipped with tungsten carbide pads which are substantial in size and which are brazed to the stabiliser blades. Where such tungsten carbide pads become detached in use, they are capable, due to their size and hardness, of causing substantial damage to the drill string components, We thus provide small hard pins as described above such that, in the event of detachment, they are incapable of seriously damaging the drill.

Additionally, it is possible to apply a known hard coating to the sleeve e.g. by weld or molten metal spray. The area heated by the application of the coating is thus not the parent material of the drill string. The coating can cover the pins, and can be re-applied when worn.

BRIEF DESCRIPTION O THE DRAWINGS

The invention is diagrammatically illustrated by way of example, in the accompanying drawings, in which:

FIG. 1 is a side view of a drill string component protected by three annular band of wear resistant sheath;

FIG. 2 is a side view of a drill string component similar to that of FIG. 1, but with a single continuous protective sheath;

FIG. 3 is a partial radial cross-section through a drill string component showing wear resisting pins positioned generally radially in a protective sheath around a drill string component and extending through the sheath, and FIG. 4 is a scrap view showing the inner ends of the wear resisting pins penetrating the drill string component.

DETAILED DESCRIPTION OF THE PREFERRED EMBODIMENTS

The preferred form of the present invention is shown in FIGS. 1,3 and 4 of the drawings and comprises a cylindrical sleeve 2 of steel which is a close fit on a drill string component 1 and which acts as a matrix carrying a closely packed array of hard pins 3 which are disposed substantially radially with their radially inner ends 5 in contact with the component and their radially outer ends 4 at the outer surface of the sleeve. The pins are cylindrical in shape and are of small diameter. They may be of 6 to 8 in length and around 14 to 16 mm apart. The pins are preferably of tungsten carbide and are preferably an interference fit in pre-drilled holes in the sleeve.

As shown in FIG. 4, the inner ends 5 of the pins may be sharpened or square ended and are arranged to penetrate the component surface to lock the sleeve and component together.

The arrangement of FIG. 2 is generally similar to that described above, but in this case the sleeve 2 is of fibre reinforced plastics, e.g. glass fibre or stainless steel reinforced epoxy plastics.

The methods of providing drill string protection of the present invention can be summarised as follows:

In this disclosure, there are shown and described only the preferred embodiments of the invention, but, as a forementioned, it is to be understood that the invention is capable of use in various other combinations and environments and is capable of changes or modifications within the scope of the inventive concept as expressed herein.

1. Sleeves e.g. aluminium, steel, fibre reinforced plastic, expanded by the use of heat, and/or the drill string component shrunk in a cold environment, the sleeve shrunk into place as required, and the pins inserted into the sleeve.

2. Sleeves shrunk by external pressure onto the drill string component.

3. Sleeves, e.g. pre-manufactured fibre reinforced plastic, shrunk onto the component by the application of heat.

4. Sleeves slid onto a tapered drill string component.

5. Sleeves and pins adhesive bonded. Any of the above methods of 1 to 4 might additionally be utilised in-this arrangement.

Formed in-situ Coating Methods

Any of the known systems of making fibre reinforced composites such as wet lay-up processes, contact moulding (spray-up), vacuum impregnation, pultrusion, filament winding or dry lay-up processes, all employing epoxy resins and the like might conceivably be used.

6. Fibrous reinforcement, impregnated by resin and preferably cured using a combination of vacuum and/or pressure plus heat.

Our current preferred systems of this type are vacuum plus injection of the resin under pressure; and the winding on of "prepreg", i.e. preimpregnated, cloth onto a heated mould and consolidated by pressure and heat.

Pins Integral in Drill Collars

7. Drill string components, substantially or completely of fibre reinforced plastic, but with a portion reinforced as described to resist wear.

Method of Pin Application

For method 1 to 5, pins are inserted through the material without pre-perforating, with pilot holes for pin guidance, with clearance holes and pin bonding, with subsequent deformation of material around the pin to assist retention, or any combination of these.

For methods 6 and 7 the pins can be inserted into the applied unimpregnated glass or the impregnated, uncured sheath, by fibre and/or resin displacement, or resin and fibre removal, e.g. by drilling. Alternatively, an applied layer can include pins formed and aligned to allow subsequent layers to engage with minimal distortion. This retaining layer can be fibre reinforced plastic, e.g. preimpregnated fibres, or metal.

The position and size of the pins can be used to control and indicate wear and need not fully penetrate the fibrous layer.

The invention thus provides improved wear and/or corrosion resisting coatings or sheaths for drill string components.

I claim:

1. A wear-resistant sheath for a cylindrical drill string component, comprising:

a matrix in the form of a tubular member of fiber-reinforced plastics materials snugly embracing the drill string component; and a closely packed array of hard pins embedded in the matrix each of the pins having a substantially cylindrical body with an radially of the sheath and with one end disposed substantially at an outer surface of the sheath.

2. A wear-resistant sheath according to claim 1, wherein:

another end of each pin is disposed to be in contact with the component.

3. A wear-resistant sheath according to claim 2, wherein:

said another end of each pin is embedded in the component to lock the sheath to the component.

4. A wear-resistant sheath according to claim 2, wherein:

said another end of each pin is adapted to penetrate a surface of the component.

5. A wear-resistant sheath according to claim 1, wherein:

the pins comprise tungsten carbide.

* * * * *